US005895206A

United States Patent [19]

Chuang et al.

[11] Patent Number: 5,895,206

[45] Date of Patent: Apr. 20, 1999

[54] FAN AND HEAT EXCHANGER ASSEMBLY

[75] Inventors: Sue-Li Chuang, Manlius; Srinivasan Subramanian, Liverpool, both of N.Y.

[73] Assignee: Carrier Corporation, Syracuse, N.Y.

[21] Appl. No.: 08/866,368

[22] Filed: May 30, 1997

[51] Int. Cl.[6] ..... B63H 1/16

[52] U.S. Cl. ..... 416/189; 416/195; 416/242

[58] Field of Search ..... 415/914; 416/169 A, 416/189, 242, 243, 195, 196 R, 223 R, 228

[56] References Cited

U.S. PATENT DOCUMENTS

| | | | |
|---|---|---|---|
| 911,540 | 2/1909 | Guilford | 416/189 R X |
| 1,506,937 | 9/1924 | Miller | 416/223 R X |
| 1,815,529 | 7/1931 | Shurtleff | 416/223 R X |
| 3,321,931 | 5/1967 | Lehnikuhl | 416/195 X |
| 3,794,443 | 2/1974 | McCarty . | |
| 4,358,245 | 11/1982 | Gray | 416/189 R |
| 4,364,712 | 12/1982 | Charles . | |
| 4,822,246 | 4/1989 | Hsu . | |
| 4,893,990 | 1/1990 | Tomohiro et al. . | |
| 5,215,441 | 6/1993 | Evans et al. | 416/223 R |

*Primary Examiner*—John E. Ryznic

[57] ABSTRACT

A mixed flow fan and heat exchanger assembly is "blow through" in that the fan discharges air into the upstream face of the heat exchanger which provides a flow resistance. The fan is mixed flow so that there are both axial and significant radial components to the air flow exiting the fan impeller. The radial components result in a static pressure facilitating flow through the heat exchanger. The assembly includes an impeller having a generally cylindrical hub and a number of backwardly swept blades. The impeller has an outlet swept radius that is greater than its inlet swept radius. A shroud encloses the impeller and guides the air flow into the impeller and to the heat exchanger. The cylindrical hub and a blade apparent solidity of less than one make the fan impeller adaptable to manufacturing in a single piece by a molding process. In a second embodiment there is a downstream blockage and the radial components to the air flow reduce impingement upon the blockage.

9 Claims, 3 Drawing Sheets

FAN AND HEAT EXCHANGER ASSEMBLY

BACKGROUND OF THE INVENTION

Air-to-refrigerant heat exchangers are commonly used in air conditioning and refrigeration systems to exchange heat between a refrigerant and air as the two fluids flow through the heat exchanger. In general, the higher the air flow rate through the heat exchanger, the better the heat transfer performance of the heat exchanger. The typical air-to-refrigerant heat exchanger used in an air conditioning or refrigeration system is of the fin and tube type. In a fin and tube heat exchanger, refrigerant flows through a closed flow path within an arrangement of tubes in the heat exchanger. Air flows over the exterior of the tubes. There are a plurality of fins extending from the exterior surface of the tubes in order to increase the surface area and thus the heat transfer performance of the tube. Other variables being equal, there must be a certain minimum air flow through a heat exchanger having a given refrigerant-to-air heat transfer area for the system that the exchanger serves to be capable of performing to its rated capacity.

Designers of air conditioning systems are constantly engaged in efforts to improve their products. One common design objective is to provide the maximum possible cooling or heating capacity in the smallest possible enclosure or the space available. Almost inevitably, configuration changes that improve one feature of a system lead to problems in another. For example, a heat exchanger designer may find it desirable to reduce the overall volume and face surface area of a heat exchanger, while maintaining the heat transfer area necessary to attain required capacity, by arranging the tubes of the heat exchanger in multiple rows. As the number of tube rows increases, the resistance to air flow through the heat exchanger also increases. Thus, increasing the number of tube rows through which the air in a heat exchanger must pass makes the task of the designer of the air movement portion of the system more difficult as that designer must provide a fan arrangement that can provide the necessary air flow rate through the heat exchanger. Resistance to air flow may also be caused by changes in the fluid path that the air flow must take.

To overcome the pressure loss through a multi-tube row heat exchanger, the fan that moves air through the heat exchanger must produce a relatively high differential pressure in the air flowing through it. Pure axial flow fans are not generally capable of producing the required differential pressure without severe compromises in performance. For instance, if an axial flow fan having a relatively small hub and long blades is used in such an application, there will be large losses at the periphery of the swept area of the fan impeller. These losses can be avoided by using an axial flow fan with a relatively large hub and short blades, but then the distribution of air flow across the heat exchanger will be less than optimal and the system thermal performance will suffer. Some of the losses associated with producing high differential pressures with an axial flow fan can be reduced by making the clearance between the tips of the fan impeller and the surrounding orifice defining shroud very small. Achieving the necessary small clearance in a typical manufacturing and assembly operation can be difficult and expensive and the designer must take steps to insure that the clearance can be maintained throughout the life of the system with little or no maintenance.

A mixed flow fan combines in a single fan the flow characteristics of both axial and centrifugal flow fans. In such a fan, a portion of a given impeller blade imparts axial movement to the air flowing through the impeller while another portion of the blade imparts centrifugal movement. Such a fan is capable of creating relatively high differential pressures when operating with a relatively high downstream flow resistance and therefore relatively high air flow rates when compared to, for example, a solely axial flow fan operating in a similar environment. Prior art mixed flow fans have typically had impeller hub shapes that promote a transition in the air entering and flowing through the fan from an axial to a radial direction. These hub shapes generally increase in diameter in an upstream to downstream direction. Such hubs present manufacturing problems, especially if a fan impeller is to be made of plastic by a molding process. The performance of a mixed flow fan is less sensitive to impeller blade tip to shroud clearance than an axial flow fan.

What is needed is a fan in combination with a heat exchanger having a relatively high air flow resistance where the fan can efficiently produce the required air flow through the heat exchanger. The configuration of the fan impeller should be such that the impeller can be made by a molding process.

SUMMARY OF THE INVENTION

This invention relates generally to air conditioning and refrigeration systems. More particularly, the invention relates to the configuration and arrangement of a shrouded air moving fan and an air-to-refrigerant heat exchanger that promotes increased air flow through the heat exchanger and thus improved heat transfer. The invention is also adaptable to use in engine cooling systems and like applications. One embodiment of the present invention is a fan and heat exchanger assembly where the heat exchanger creates a relatively high air flow resistance. The fan is of the mixed flow type that produces both axial and radial air flow through it. The assembly includes an impeller and a stationary shroud that guides and turns the air flow through the fan impeller toward the upstream face of the heat exchanger where the heat exchanger is located downstream. In another embodiment, the heat exchanger is located upstream of the fan and there is a flow blockage downstream of the fan such as an engine block or a wall, the fan draws air through the heat exchanger and provides at least a partial radial discharge to reduce flow energy losses caused by impingement upon the downstream flow blockage. To achieve an essentially drop in design, the traditional axial fan orifice or shroud is shortened and the blades of the impeller are radially extended in the portion downstream of the fan orifice or shroud. It should be noted that if the downstream resistance is low, the flow direction is predominantly axial and this condition would be unsuitable to achieve the benefits of the present invention. If, however, the downstream resistance is high or substantially blocked such that the flow is forced to turn radially, the flow near the tips of the blades has larger radial components with the blades thereby acting like the blades of a centrifugal fan and generating a higher static pressure to get more flow through the downstream resistance and/or to radially direct the flow. Additionally, because of the radial component, there will be decreased flow energy losses caused by the impingement in the case of a downstream blockage. The blade apparent solidity factor of the impeller is less than one and, unlike many prior art mixed flow fans, the impeller hub is generally cylindrical in shape, both features facilitating manufacture of the impeller in one piece using a molding process.

It is an object of this invention to provide a higher static pressure.

It is another object of this invention to provide a fan suitable for operation in a tight space.

It is an additional object of this invention to make the best usage of limited space available as in existing axial fan applications.

It is a further object of this invention to provide a modified axial fan suitable for use in combination with a high resistance downstream. These objects, and others as will become apparent hereinafter, are accomplished by the present invention.

Basically, a conventional axial fan is modified by reducing the axial extent of the fan orifice or shroud and by increasing the radial extent of blades of the fan impeller which are radially extended in the portion downstream of the fan orifice or shroud.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
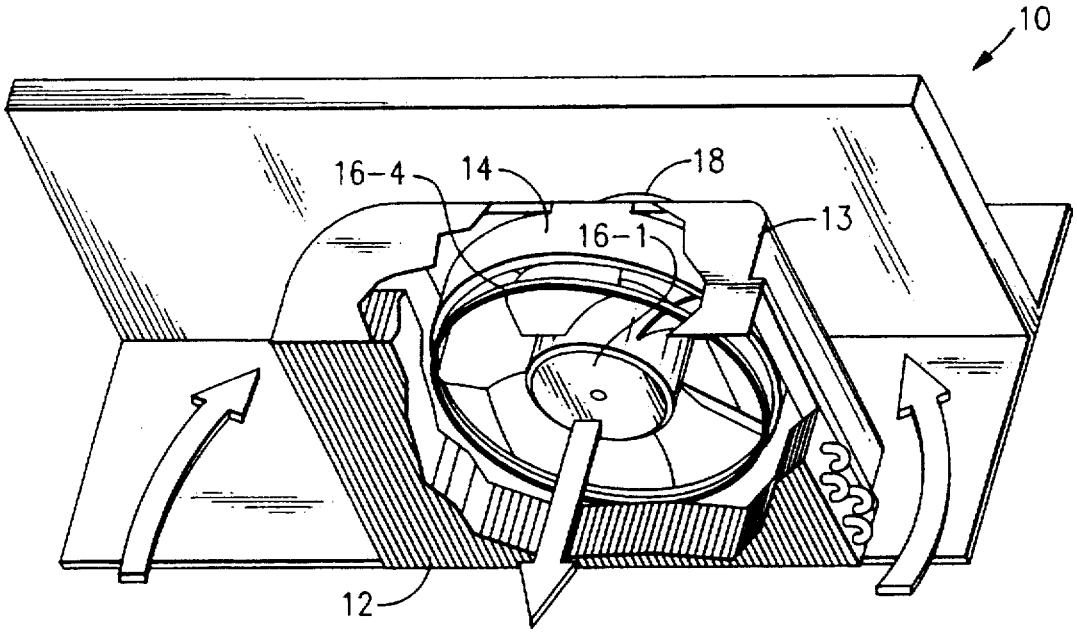
FIG. 1 is a partially cutaway pictorial view of a portion of packaged terminal air conditioner, PTAC, unit employing the fan of the present invention.
Figure 2:
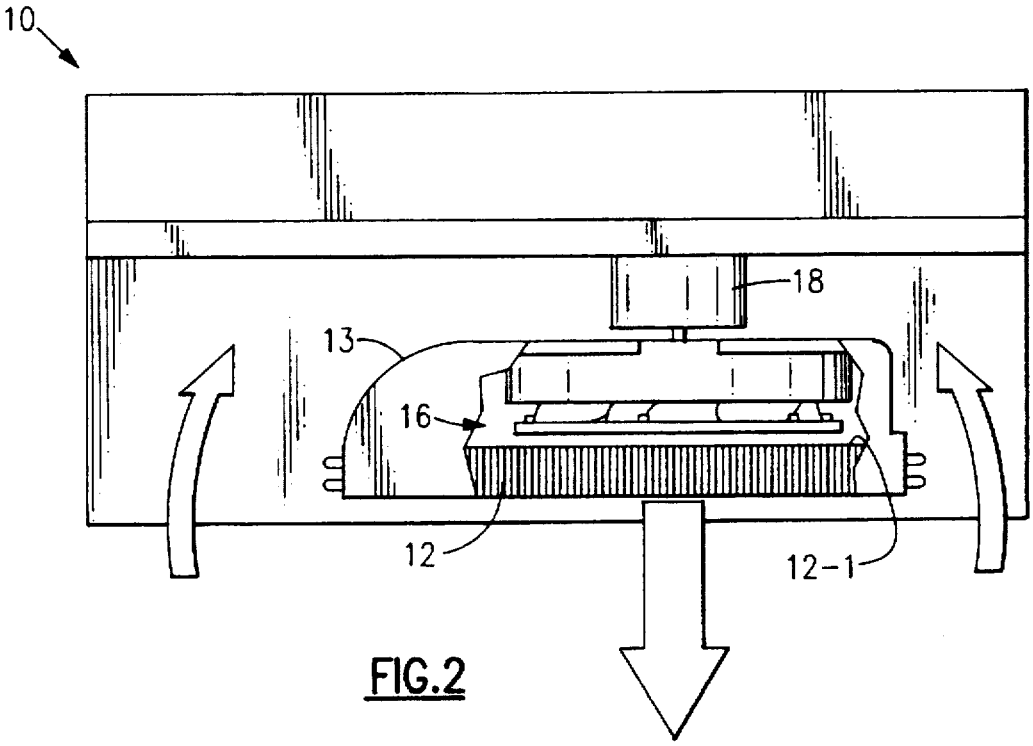
FIG. 2 is a top view of the structure of FIG. 1.
Figure 3:
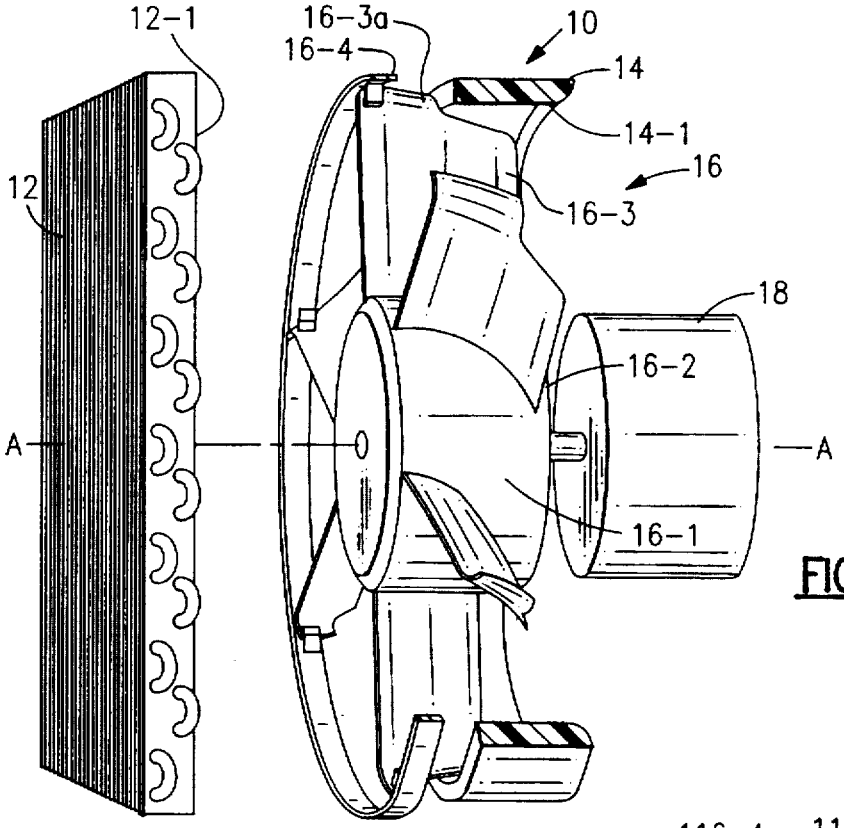
FIG. 3 is a partially sectioned view of the fan and heat exchanger assembly of the present invention.

In FIGS. 1–3 the numeral 10 generally designates a fan and heat exchanger assembly such as may be found in a packaged terminal air conditioner or PTAC unit. Assembly 10 includes heat exchanger 12, stationary shroud or orifice ring 14 of the condenser orifice assembly and fan 16. Shroud or orifice ring 14 is supported by preferably integral support member 13. Heat exchanger 12 has upstream face 12-1. Fan 16 includes impeller 16-1, hub 16-2, a plurality of blades 16-3 with integral slinger ring 16-4 and is driven by motor 18 about axis A-A. Preferably impeller 16-1, hub 16-2, blades 16-3 and slinger ring 16-4 are injection molded plastic and constitute a single piece. As is best shown in FIG. 3, the tip 16-3*a* of each blade 16-3 is of varying radial extent and may have a backward curved exit angle. Specifically, the upstream or leading edge portions of blades 16-3 are radially spaced from and within opening 14-1 in orifice ring or stationary shroud 14 and define the inlet swept radius of impeller 16-1. Blades 16-3 have an extended tip edge or paddle strip 16-3*a* which are axially spaced from orifice ring or stationary shroud 14, which have a radial extent at least nominally equal to that of opening 14-1 and which define the outlet swept radius of impeller 16-1. The increased radial extent of paddle strips 16-3*a* may be on the order of 0.25 inches with the outer diameter of slinger ring 16-4 defining the normal maximum outer radial dimension of paddle strips 16-3*a*. Both the reduced axial extent of orifice ring 14 and the provision of paddle strips 16-3*a* are necessary such that fan 16 can be a drop in replacement in a conventional prior art design while achieving the benefits of the present invention.

Figure 4:
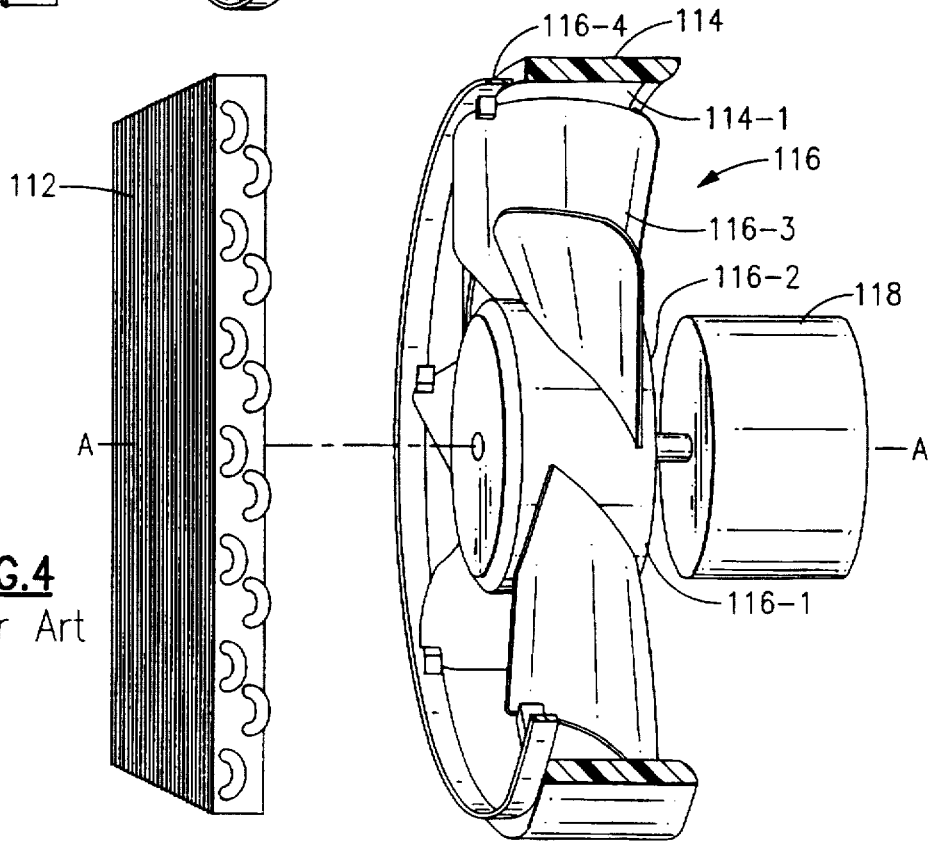
FIG.4 Prior Art
FIG. 4 is a view corresponding to FIG. 3 and showing a PRIOR ART device.

The present invention can be best appreciated with reference to FIG. 4 which is a view of a PRIOR ART device corresponding to FIG. 3 and with corresponding structure numbered one hundred higher. In comparing FIGS. 3 and 4, it is readily apparent that orifice ring or shroud 14 is of a lesser axial extent than shroud 114 and that blades 16-3, because of the presence of paddle strip 16-3*a*, have a greater radial extent with their greatest radial extent downstream of shroud 14 whereas blades 116-3 have their greatest axial extent radially inward of opening 114-1 of shroud 114. The combination of these two features changes the axial flow of fan 116 to the mixed flow of fan 16 with the pressure rise being the sum of the airfoil action found in axial fans plus the centrifugal action resulting from the change of radius.

Referring to FIGS. 1 and 2, it will be noted by virtue of the arrows indicating flow that there are two inlets or flow paths supplying fan 16. In the PTAC unit illustrated, the flow from the left side passes over and cools the compressor (not illustrated) while the flow from the right side represents ambient air. Heat exchanger 12 is downstream of fan 16 and represents a flow resistance. However, the increased static pressure due to the centrifugal action causes a greater flow through heat exchanger 12 than would fan 116 if the only differences were the presence of paddle strips 16-3*a* and the shortening of the axial extent of orifice ring 114. Assuming that fan 116 was adequate for the design, the use of fan 16 represents extra capacity which can accommodate an increase in the heat exchanger 12 and therefore in system capacity or may permit the use of a smaller fan.

Figure 5:
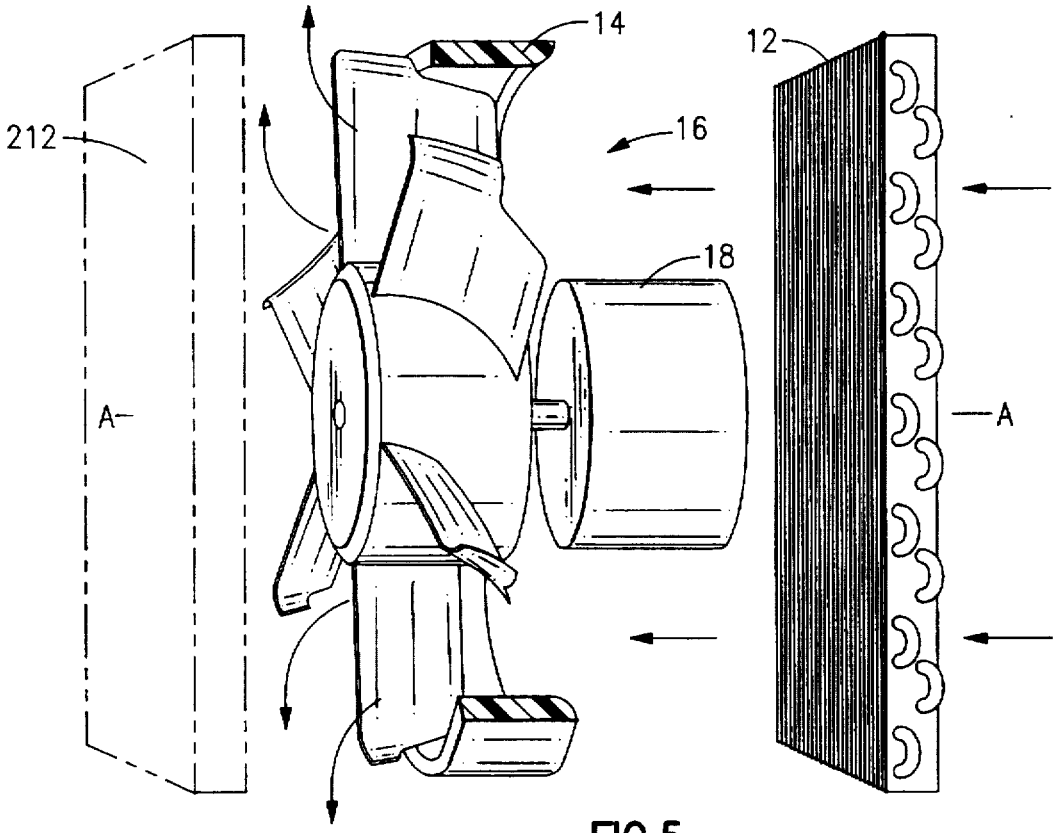
FIG. 5 is a view corresponding to FIG. 3 and showing a transport refrigeration application.

In the fan and heat exchanger assembly 10 of FIGS. 1–3, the heat exchanger 12 is a flow resistance but flow does take place through the heat exchanger 12 facilitated by the increased static pressure. In transport refrigeration, for example, the refrigeration unit is located entirely exterior of the trailer so as to maximize cargo space and the refrigeration unit is made as compact as possible to permit its being located between the truck cab and the trailer while permitting the articulation necessary for the truck to make turns. Accordingly, the design may have a fan drawing air through a heat exchanger and discharging against a wall before flowing into the air distribution structure. Alternatively, the fan may draw air through the radiator and discharge the air such that the engine block constitutes a flow blockage relative to axial flow. The present invention reduces the amount of air impinging upon a wall or the like since the centrifugal component is a radial discharge. FIG. 5 illustrates the adaptation of the present invention to transport refrigeration and it generally corresponds to modifying FIG. 3 by locating heat exchanger or radiator 12 upstream of fan 16 and with solid wall or engine block 212 located downstream of fan 16. Because there is an axial component of the fan output, some of the air will impinge against engine block or wall 212 but the radially discharged centrifugal portion will be discharged without impingement with engine block or wall 212.

Figure 6:
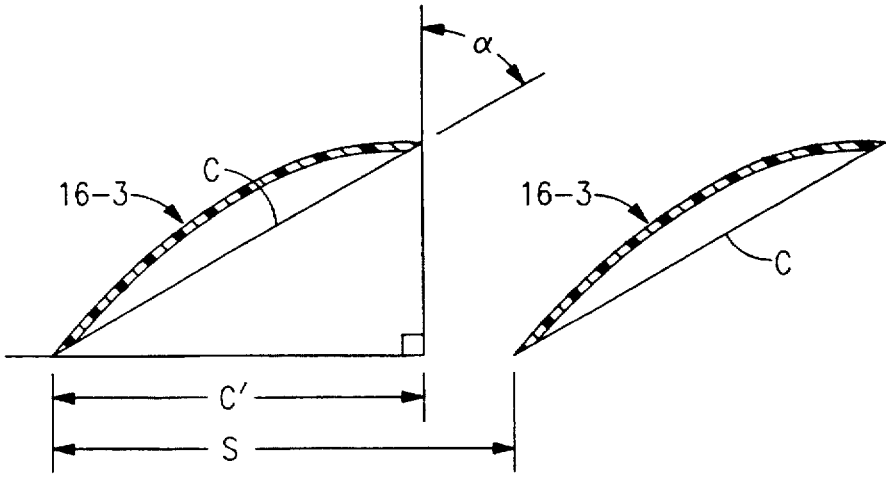
FIG. 6 is a diagram to assist in defining the term "blade apparent solidity".

So that impeller 16-1 can be manufactured in one piece by a molding process, it is necessary that hub 16-2 be generally cylindrical. Prior art teaching has been that a mixed flow fan requires an impeller hub having a shape, e.g. conical, that promotes the axial to radial flow transition. Hub 16-2, even though cylindrical, can accomplish the same effect. In operation, there is a layer of separated air along the cylindrical surface of the hub. The thickness of the separated flow layer increases from upstream to downstream along the surface. The thickening layer at the hub acts to turn incoming flow very much like a prior art mixed flow impeller hub. The separated flow layer does not significantly affect the flow performance of the fan. Manufacturing impeller 16-1 in one piece by a molding process also requires that the impeller have a blade apparent solidity factor of less than one. FIG. 6 shows two adjacent impeller blades 16-3. The blades are set at stagger angle $\alpha$. Blade spacing s is the distance between two similar points on adjacent blades. Blades 16-3 have chord length c. Blade solidity factor ($\sigma$) is the chord length divided by the blade spacing, or $\sigma=c/s$. The apparent chord length is c', where $c'=c \sin \alpha$. Apparent blade solidity factor ($\sigma'$) is the apparent chord length divided by the blade spacing, or $\sigma'=c'/s$. If the apparent blade solidity factor in an impeller is less than one, there is no blade overlap making it possible to mold such an impeller in one piece.

To achieve optimum performance, the fan of the present invention must work against a relatively high exhaust back pressure. To achieve this in a flow through configuration, it is necessary that the duct portion of the shroud direct essentially all of the fan discharge against the upstream face of the heat exchanger and that the heat exchanger be located relatively close to the downstream end fan impeller, i.e. the distance between impeller and upstream face being on the order of two times the maximum swept radius of the impeller or less. To achieve this in a draw through arrangement with a blocked or diverted discharge flow configuration, the flow distribution structure of flow path should be such that at least a portion of the flow is directed radially outward of the impeller.

Although preferred embodiments of the present invention have been illustrated and described other changes will occur to those skilled in the art. It is therefore intended that the scope of the present invention is to be limited only by the scope of the appended claims.

What is claimed is:

1. An assembly comprising:

a fan having an axis and including an impeller;

said impeller having a first portion having an inlet swept radius and a second portion having an outlet swept radius with said outlet swept radius being greater than said inlet swept radius;

a shroud defining an opening axially spaced from said second portion and said shroud being located radially outward of and coacting with at least a part of said first portion;

said second portion having a greater radial extent than said opening;

means for supporting said shroud;

motor means for driving said fan;

a flow resistance axially spaced from said second portion;

whereby when said motor means drives said fan, said fan acts as a mixed flow fan so as to produce an increased static pressure.

2. The assembly of claim 1 wherein said flow resistance is a heat exchanger.

3. The assembly of claim 1 wherein said flow resistance is a solid member.

4. The assembly of claim 3 wherein said flow resistance is located downstream of said fan.

5. The assembly of claim 1 wherein said fan has a generally cylindrical hub.

6. The assembly of claim 1 wherein said fan has a bladed apparent solidity factor of less than one.

7. The assembly of claim 1 wherein said fan includes a single member defining a hub and said impeller.

8. The assembly of claim 7 wherein said single member further includes a slinger ring.

9. An assembly comprising:

a fan having an axis and including an impeller;

said impeller having a first portion having an inlet swept radius and a second portion having an outlet swept radius with said outlet swept radius being greater than said inlet swept radius;

said second portion has a portion which is backwardly curved;

a shroud axially spaced from said second portion and located radially outward of and coacting with at least a part of said first portion;

means for supporting said shroud;

motor means for driving said fan;

a flow resistance axially spaced from said second portion;

whereby when said motor means drives said fan, said fan acts as a mixed flow fan so as to produce an increased static pressure.

* * * * *